US007387163B2

(12) United States Patent
Seegers et al.

(10) Patent No.: US 7,387,163 B2
(45) Date of Patent: Jun. 17, 2008

(54) IN-SITU LANDFILL GAS WELL PERFORATION METHOD AND APPARATUS

(75) Inventors: Raymond Seegers, Milwaukee, WI (US); Steve Meyer, Hilbert, WI (US)

(73) Assignee: Waste Management Inc., Cincinnati, OH (US)

( * ) Notice: Subject to any disclaimer, the term of this patent is extended or adjusted under 35 U.S.C. 154(b) by 118 days.

(21) Appl. No.: 10/973,125

(22) Filed: Oct. 26, 2004

(65) Prior Publication Data

US 2007/0062701 A1 Mar. 22, 2007

(51) Int. Cl.
*E21B 43/11* (2006.01)

(52) U.S. Cl. ..... 166/298; 166/55

(58) Field of Classification Search ..... 166/297, 166/298, 55, 55.1, 55.2
See application file for complete search history.

(56) References Cited

U.S. PATENT DOCUMENTS

| | | | | |
|---|---|---|---|---|
| 4,134,453 | A * | 1/1979 | Love et al. | 166/298 |
| 5,295,763 | A | 3/1994 | Stenborg et al. | |
| 5,458,006 | A | 10/1995 | Roqueta | |
| 5,616,841 | A | 4/1997 | Brookshire | |
| 5,701,958 | A * | 12/1997 | Braziel | 166/298 |
| 6,169,962 | B1 * | 1/2001 | Brookshire et al. | 702/47 |
| 6,505,681 | B2 | 1/2003 | Catanla et al. | |
| 6,742,962 | B2 | 6/2004 | Hater et al. | |

* cited by examiner

*Primary Examiner*—Giovanna C Wright
(74) *Attorney, Agent, or Firm*—McDonnell Boehnen Hulbert & Berhgoff LLP

(57) ABSTRACT

The present invention relates to a method and apparatus for perforating a landfill gas well in situ. The invention allows for improved recovery of gas from a gas well without the danger of explosion.

17 Claims, 1 Drawing Sheet

IN-SITU LANDFILL GAS WELL PERFORATION METHOD AND APPARATUS

FIELD OF THE INVENTION

The present invention relates to methods and devices for in situ perforation of landfill gas wells.

BACKGROUND OF THE INVENTION

The decomposition of waste in a landfill produces methane and other gaseous emissions. Landfill gas recovery wells are used to remove the gases from landfills. Removal of methane and other gases is both an environmental and a safety measure for preventing an accumulation of flammable gases. The gas wells typically consist of pipes made from PVC, high-density polyethylene (HDPE) and similar materials. The gas well's pipes are slotted or perforated to allow for recovery of the gases. However, over time the slots and perforations become clogged as a result of the formation of precipitates and biological films in the well. Consequently, the amount of gas recovered or produced from a well may decrease over time.

Another problem with the gas well piping is that it is often installed as the landfill lifts are created. Consequently, the top section of the pipe is not perforated because it must be extended over time as additional lifts are added to the landfill.

The current solution to these problems is to install a new gas well next to the existing, obsolete well. However, this is time consuming and expensive. Thus, a simple and inexpensive solution that allows retrofitting of an existing well to maintain the amount of gas produced over time is needed.

BRIEF SUMMARY OF THE INVENTION

The present invention relates to perforating devices useful for perforating an in situ landfill gas well to increase gas recovery. The perforating device consists of at least one perforator with at least one cutting edge. The perforating device also has a cable for lowering and raising the perforating device in the gas well. The perforating device further features cutting edges in the form of a drilling system and/or rotator to allow perforation of the gas well. Finally, the diameter of the perforating device is less than the inner diameter of the gas well.

The present invention also relates to methods for in-situ perforation of a landfill gas well to increase gas recovery. A perforating device is lowered into the gas well to a predetermined depth from the landfill surface until the perforating device is adjacent to a portion of the gas well to be perforated. Next, the perforating device is activated at the predetermined depth to perforate a portion of the gas well. After perforating the gas well at one or more predetermined depths, the perforating device is removed from the gas well.

DETAILED DESCRIPTION OF THE INVENTION

The invention provides a perforating device and method for perforating a landfill gas well in situ.

Figure 1:
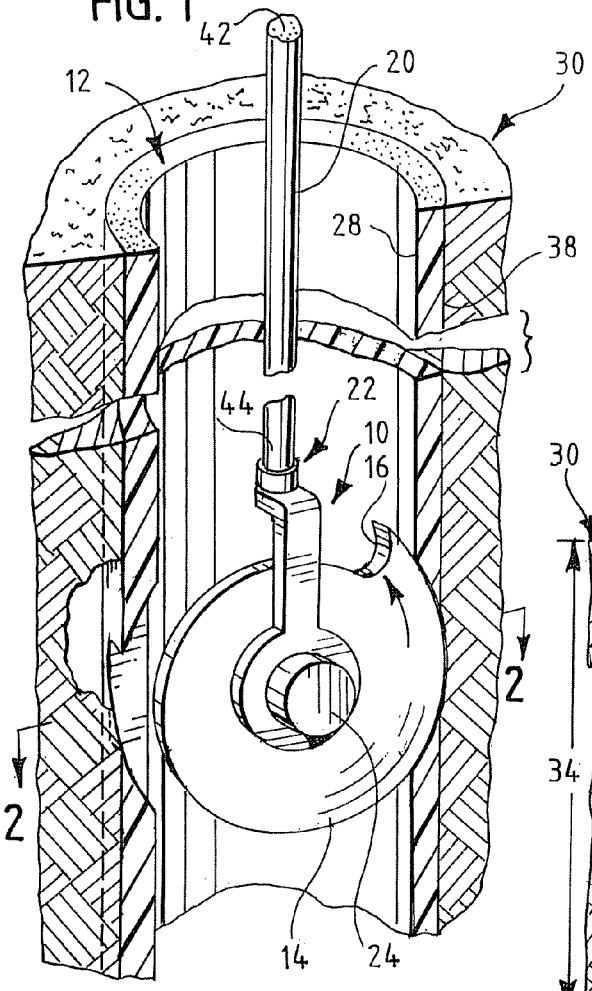
FIG. 1 is an illustration of an embodiment of perforating devices of this invention.
Figure 2:
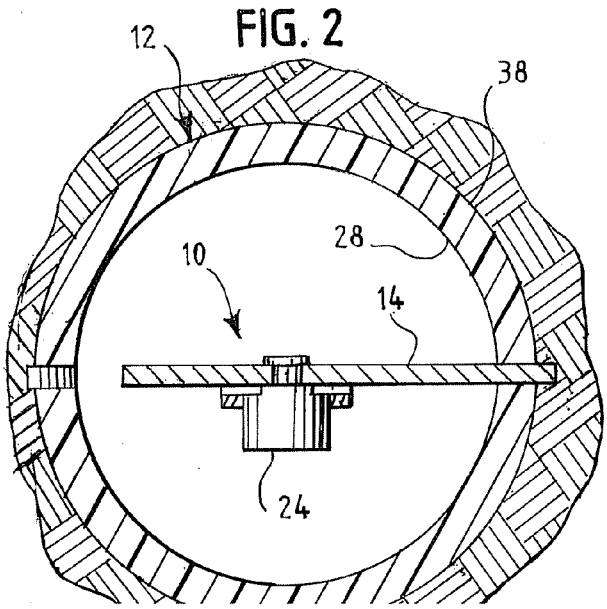
FIG. 2 is a cross-sectional representation of the embodiment illustrated in FIG. 1.

FIGS. 1 and 2 illustrate an embodiment of a perforating device 10 used to perforate a landfill gas well 12 in situ. Typically, gas well 12 is constructed of PVC, high-density polyethylene (HDPE) or other similar materials. Gas well 12 typically has an inner wall 28 and an outer wall 38. Gas well 12 has an effective inner diameter 32 ranging from about six to about twelve inches. Typically, effective inner diameter 32 is about eight inches. Perforating device 10 consists of at least one perforator 14 that has at least one cutting edge 16. Perforator 14 is made from a material that is able to perforate landfill gas wells, such as steel, and typically weighs one to three pounds or more. Perforating device 10 has a diameter 18 that is less than effective inner diameter 32 of gas well 12. For instance, diameter 18 of perforating device 10 is four inches, compared to an effective inner diameter 32 of eight inches. Preferably, diameter 18 of perforating device 10 ranges from four to six inches. Perforating device 10 also includes a cable 20, which may be used to lower and raise perforating device 10 into and out of gas well 12. Cable 20 has a first end 44 and a second end 42. Cable 20 is attached at the first end 44 to a top surface 22 of perforator 14 by a connector. The second end 42 is kept at a landfill surface 30. Cable 20, in addition, may have a measuring mechanism for determining the distance from landfill surface 30 to perforating device 10 in gas well 12. For example, the cable may be a hydraulic hose or a stainless steel cable that is graduated to measure length. However, a graduated stainless steel cable is preferable. Perforating device 10 may also include a power source, such as a hydraulically or pneumatically powered motor. Additionally, perforating device 10 has a rotator 24. Rotator 24 may be any device capable of driving a cutting edge, but will typically consist of a gear and rotating shaft. Rotator 24 activates perforator 14 thus allowing cutting edges 16 to perforate a portion 26 of gas well 12.

In another embodiment of the invention, perforating device 10 is a drilling system. The drilling system is hydraulically or pneumatically powered, and made from hardened steel or carbide. Preferably, the drilling system is hydraulic because a hydraulic drilling system can reduce the risks associated with the explosive nature of landfill gas. Furthermore, the drilling system may have adjustable settings. For example, the perforating device 10 may be configured to have four or six perforating drills, with each having a cutting edge 16 to perforate holes into the gas well's circumference. Adjustable settings allow a user of perforating device 10 to select a desired number of perforations to be perforated or drilled in gas well 12. The adjustable setting is chosen before perforating device 10 is lowered into gas well 12. The size of the drill bit used to perforate the well may be adjusted to adjust the size of the perforation in the gas well. Typically, a perforation will be approximately one half inch. However, the perforation size may vary in order to keep the perforation size smaller than the gas well's granular backfill material, thus preventing the backfill material from seeping through.

Another aspect of perforating device 10 is that it may be stabilizable. For example, perforating device 10 may have one or more retractable arms that extend outward to inner wall 28 of gas well 12. This enhances the stability of perforating device 10 while it perforates gas well 12 by maintaining the position of perforating device 10 in gas well 12. Moreover, stabilizing the perforating device 10 provides for easier removal of perforating device 10 from gas well 12.

The present invention also provides a method of in-situ perforation of a landfill gas well. The method begins by lowering the perforating device 10 into gas well 12. Gas well 12 generally should have a straight vertical orientation. However, often gas well 12 will not be vertical due to landfill forces that cause some misalignment. This misalignment typically results from extending gas wells to accommodate additional landfill lifts. This invention addresses this problem providing perforating device 10 with a short body, and a smaller diameter than the inner diameter 32 of the gas well. As a result, it is possible to lower the perforating device 10 to gas well depths beyond the misaligned areas. Perforating device 10 is lowered into gas well 12 to a predetermined depth 34 from landfill surface 30. At predetermined depth 34, perforating device 10 is adjacent to portion 26 of gas well 12. Perforating device lowering is done either manually or automatically. Manual lowering is accomplished by manually lowering perforating device 10 into gas well 12 with cable 20. Automatic lowering may be done with a power source, hydraulic or pneumatic, which may be used to power the lowering of perforating device 10 into gas well 12.

Once perforating device 10 is located at a predetermined depth 34 from landfill surface 30, perforating device 10 is activated. Perforating device 10 perforates portion 26 at predetermined depth 34, which is adjacent to perforating device 10. Perforation is accomplished by drilling or cutting system. Perforating device 10 may rotate vertically within gas well 12, thus perforating gas well 12 in an up and down manner.

The step of positioning perforating device 10 at predetermined depth 34 from landfill surface 30 and then perforating gas well 12 may be done once or it may be repeated a plurality of times at various predetermined depths from landfill surface 30. Perforations will be made each time the perforating device 10 is activated at the predetermined depth 34. Typically, the perforations are done in six-inch increments throughout the gas well 12. The ability to recover landfill gas is improved by maximizing the number of perforations in the gas well 12. Perforating the gas well too close to the landfill surface 30 can contribute to air infiltration. Thus, perforations should be made approximately twenty feet from the landfill surface 30. The steps of the present invention will be repeated until all desired portions of gas well 12 are perforated. After the gas well 12 is sufficiently perforated the perforating device is pulled from the gas well 12, and back to the landfill surface 30. The step of pulling perforating device 10 out of gas well 12 may be accomplished manually or automatically. In another embodiment, perforating device 10 is attached to a winch that powers pulling perforating device 10 out of gas well 12 and back to landfill surface 30.

Figure 3:
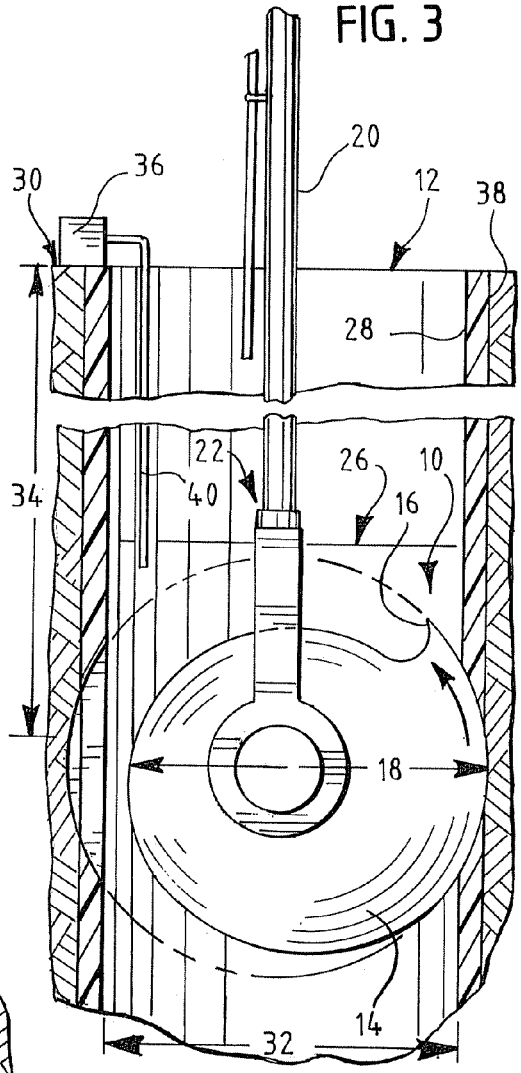
FIG. 3 is an alternative embodiment which illustrates the gas monitoring aspect of the present invention.

FIG. 3 illustrates another embodiment of the method of this invention that includes a step for maintaining the amount of methane gas in gas well 12 outside methane gas's explosivity range. Methane gas has an explosivity range of 5 to 15% by volume. This is a necessary safety precaution, which ensures the methane gas located in gas well 12 does not ignite to cause an explosion during the perforation steps. If while monitoring the amount of methane gas in the gas well it is found to be within methane gas's explosivity range, no perforating of the gas well should be done. For example, to get outside the explosivity range may involve introducing a sufficient amount of inert gas into gas well 12. For instance, introducing nitrogen into gas well 12. Monitoring the amount of methane gas inside gas well 12 may be accomplished in several ways. For example, it can be accomplished by monitoring the percent of methane gas in gas well 12 with a gas sensing device 36 that is connected to a sample tube 40. Gas well sensing device 36 will be placed at landfill surface 30. Sample tube 40 extends from landfill surface 30 down into gas well 12, where sample tube 40 is mounted next to perforating device 10. Attaching sample tube 40 to the cable 20 allows for easier monitoring of gas in the vicinity of the predetermined depth 34 in the gas well 12. Thus, allowing monitoring of methane gas in the vicinity of predetermined depth 34. Alternatively, gas sensing device 36 may be attached to perforating device 10. Gas well sensing device 36 may be a gas well sensor for monitoring methane gas concentration that is known by those of ordinary skill in the art. One common gas well sensor is the GEM™500, which is manufactured by CES-Landtec. The GEM™500 is used to analyze gas content and determine flow from LFG collection wellheads.

Another embodiment of the method of this invention involves applying steps of the invention's method to a gas well that as become filled with water at the predetermined depth. In other words, the gas well contains water prior to lowering the perforating device into the gas well. The water in the gas well can prevent the extraction of gases from the gas well. The invention's method of perforating the gas well with a perforating device may be accomplished in a water filled portion of gas well 12 to create slots or perforations, for draining the water from the gas well. As a result, it becomes possible to recover gas from previously water filled gas wells.

The invention is now described in such full, clear, concise and exact terms as to enable any person skilled in the art to which it pertains, to make the same. It is to be understood that the foregoing describes preferred embodiments of the present invention and that modifications may be made therein without departing from the spirit or scope of the invention as set forth in the claims.

The invention claimed is:

1. A method for in-situ perforation of a landfill gas well, comprising the steps of:

(a) lowering a perforating device into a gas well until the perforating device is adjacent to a portion of the gas well located at a first predetermined depth from a landfill surface;

(b) activating the perforating device at the first predetermined depth and perforating the portion of the gas well adjacent to the perforating device; and (c) maintaining an amount of methane gas inside the gas well outside of methane gas explosivity range of 5-15%.

2. The method of claim 1, further comprising repeating step (b) at a plurality of predetermined depths.

3. The method of claim 2, further comprising removing the perforating device from the gas well after the gas well is perforated at all the predetermined depths.

4. The method of claim 3, wherein the step of removing is accomplished by attaching a cable to the perforating device and keeping the second end of the cable on the landfill surface and then removing the perforating device from the gas well by coiling the cable at the landfill surface.

5. The method of claim 1, wherein the effective diameter of the gas well is from about 6 to about 12 inches.

6. The method of claim 5, wherein the effective diameter of the gas well is about 8 inches.

7. The method of claim 1, wherein the step of lowering is accomplished manually with a cable attached to the perforating device.

8. The method of claim 1, wherein the step of lowering is accomplished automatically with a cable attached to the perforating device.

9. The method of claim 7 or 8, wherein the cable is graduated.

10. The method of claim 9, wherein the cable is selected from a hydraulic hose or a metal cable.

11. The method of claim 1, wherein the step of perforating is accomplished by the perforating device selected from a group consisting of a hydraulic drilling system or a pneumatic drilling system.

12. The method of claim 1, further comprising:

(d) monitoring the amount of methane gas in the gas well, (e) perforating the gas well when the amount of methane gas is outside of the explosivity range, and (f) removing the perforator from the gas well when the amount of methane gas is within the explosivity range.

13. The method of claim 12, further comprising monitoring the percent of methane gas with a gas well sensing device connected to a sample tube.

14. The method of claim 13, wherein the gas well sensor remains at a landfill surface and the sample tube is extended from the landfill surface to the predetermined depth of the gas well.

15. The method of claim 14, wherein the sample tube is mounted next to the perforating device at the predetermined depth.

16. The method of claim 1, wherein maintaining the amount methane gas outside the explosivity range is accomplished by adding an inert gas to the gas well.

17. The method of claim 1, further comprising performing steps (a), (b), and (c) in a gas well which contains water at the predetermined depth.

* * * * *